US008485098B2

(12) United States Patent
Gaisbauer

(10) Patent No.: US 8,485,098 B2
(45) Date of Patent: Jul. 16, 2013

(54) DECOY WITH A SIMPLE SAFETY DEVICE

(75) Inventor: Rainer Gaisbauer, Schönau (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 40 days.

(21) Appl. No.: 12/900,258

(22) Filed: Oct. 7, 2010

(65) Prior Publication Data

US 2011/0297033 A1 Dec. 8, 2011

Related U.S. Application Data

(63) Continuation-in-part of application No. PCT/EP2009/001975, filed on Mar. 18, 2009.

(30) Foreign Application Priority Data

Apr. 7, 2008 (DE) ..... 10 2008 017 725

(51) Int. Cl.
*F42C 15/34* (2006.01)

(52) U.S. Cl.
USPC ..... 102/256; 102/254; 102/342; 102/351; 102/357

(58) Field of Classification Search
USPC ..... 102/222, 254, 256, 342, 351, 357, 102/229, 336, 481
See application file for complete search history.

(56) References Cited

U.S. PATENT DOCUMENTS

| | | | | |
|---|---|---|---|---|
| 2,389,782 | A | 11/1945 | Jackson, Jr. | |
| 4,029,014 | A | 6/1977 | Cunningham | |
| 5,561,259 | A * | 10/1996 | Herbage et al. | 102/334 |
| H1603 | H | 11/1996 | Deckard et al. | |
| 5,660,357 | A | 8/1997 | Grossman et al. | |
| 5,763,818 | A | 6/1998 | Guymon et al. | |
| 6,588,343 | B1 | 7/2003 | Mulinix | |
| 6,634,301 | B1 * | 10/2003 | Mulinix | 102/336 |
| 6,679,174 | B1 | 1/2004 | Mulinix | |
| 2007/0266882 | A1 | 11/2007 | Gaisbauer et al. | |
| 2009/0251353 | A1 | 10/2009 | Bannasch et al. | |

FOREIGN PATENT DOCUMENTS

| | | | |
|---|---|---|---|
| DE | 84 01068 | U1 | 10/1984 |
| DE | 38 28 501 | C1 | 10/1989 |
| DE | 690 15 046 | T2 | 4/1995 |
| DE | 199 51 767 | C2 | 6/2002 |
| DE | 10 2004 047 231 | A1 | 4/2006 |
| DE | 601 19 735 | T2 | 4/2007 |
| GB | 2 300 035 | A | 10/1996 |
| WO | 2007/012371 | A1 | 2/2007 |

OTHER PUBLICATIONS

International Search Report of International Application No. PCT/EP2009/001977, issued in co-pending U.S. Appl. No. 12/900,339, completed Jul. 17, 2009, mailed Jul. 27, 2009.

(Continued)

*Primary Examiner* — James Bergin
(74) *Attorney, Agent, or Firm* — Griffin & Szipl, P.C.

(57) ABSTRACT

The invention relates to a safety device (1) for a block of explosive material, forming a missile decoy, that is introduced into an explosive material container (2) with a sabot (4) and an ignition transmission charge (5). The safety device (1) is characterized by a prestressed tube sensor/slide (6) that is connected between the sabot (4), the ignition transmission charge (5) and the explosive material container (2) such that it can release or re-close an ignition channel (13) disposed between the ignition transmission charge (5) and the explosive material.

12 Claims, 6 Drawing Sheets

OTHER PUBLICATIONS

Office Action issued in co-pending related U.S. Appl. No. 12/900,339 on Apr. 20, 2012.
Webster's New Collegiate Dictionary 404 (1977).
International Search Report issued in corresponding application No. PCT/EP2009/001975, mailed Jul. 10, 2009, mailed Jul. 21, 2009.
Webster's Ninth New Collegiate Dictionary 1072 (1990).

* cited by examiner

DECOY WITH A SIMPLE SAFETY DEVICE

This is a Continuation-in-Part Application (Continuation Application) in the United States of International Patent Application No. PCT/EP2009/001975 filed Mar. 18, 2009, which claims priority on German Patent Application No. DE 10 2008 017 725.3, filed Apr. 7, 2008. The entire disclosures of the above patent applications are hereby incorporated by reference.

FIELD OF THE INVENTION

The invention relates to a safety device for a munition or warhead, which forms a decoy, for example, a missile decoy, with a novel housing design.

BACKGROUND OF THE INVENTION

Explosive containers, for example, for concealment functions against missile attack, are sufficiently well known from practical use. By way of example, DE 10 2004 047 231 A1 describes an explosive block or an active agent body, as does corresponding U.S. Patent Application Publication No. US 2007/0266882 A1. U.S. Patent Application Publication No. US 2007/0266882 A1 is incorporated herein in its entirety for all it discloses. Containers such as these overall form a submunition for forming a decoy, for example, as described in DE 199 51 767 C2.

Submunitions that are composed of explosive containers such as these are known, inter alia, from DE 601 19 735 T2.

A method and an apparatus for decoying IR, RF and dual-mode guided missiles using these submunitions is disclosed in WO 2007/012371 A1, which corresponds to U.S. Patent Application Publication No. US 2009/0251353 A1. U.S. Patent Application Publication No. US 2009/0251353 A1 is incorporated herein in its entirety for all that it discloses. A firing device for a firing chain for submunition bodies is disclosed in DE 690 15 046 T2.

Containers such as these are ejected successively, and are fired individually, and require a safety device, in particular for a possible defect situation.

The invention is based on the object of specifying a simple safety device for a system, which simulates an apparent target.

SUMMARY OF THE INVENTION

The object of the invention is achieved by the features of a first embodiment, which pertains to a safety device (1) for a block of explosives that forms a decoy and is incorporated in an explosive container (2), having a discarding sabot (4) and a firing stemming charge (5), characterized by a prestressed tube sensor/slide (6), which is incorporated between the discarding sabot (4), the firing stemming charge (5) and the explosive container (2), such that it can open or reclose a firing channel (13) between the firing stemming charge (5) and the explosive. Advantageous embodiments can be found in the other described embodiments. For example, in accordance with a second embodiment of the present invention, the first embodiment is modified so that the tube sensor (6) is physically U-shaped (8, 9), wherein tabs 10 are fitted to these webs (8, 9) in order to ensure the final position of the tube sensor (6) in the safety device (1), and a structure (11) in the form of a polygonal column with an opening (12) is incorporated between the two webs (8, 9).

The invention is based on the idea of including a simple safety device in addition to a novel equipment design of the decoy. The safety device itself comprises a so-called "tube sensor/slide" with springs, and is structurally included to interact with a discarding sabot and a firing stemming charge of the decoy. The safety device and/or parts of it and an explosive container of the decoy preferably form a physical unit. The discarding sabot and the firing stemming charge are preferably connected in an interlocking manner to the explosive container via a click-fastening system.

The firing stemming charge is held in its position during the reaction (in the function of the charge) by the click-fastening connection between the discarding sabot and the explosive container in the area of the safety device, and the design configuration of the discarding sabot, the result of which it need no longer be adhesively bonded in place, and, therefore, can be replaced or exchanged at any time.

The special feature of the safety device is the design configuration of the tube sensor, which influences the safety, function and effect of the decoy to a major extent.

The tube sensor is designed such that, once the firing channel to the explosive has been released, the firing chain can be interrupted again. This results in the safety advantage that, if the firing chain does not operate correctly, the explosive container emerging from the casing of the submunition can be considered as being safe to handle again once a specified waiting time has elapsed. The final closure of the firing channel furthermore assists the separation between the explosive container and the explosive, and prevents energy loss by "blowing out", therefore contributing to the optimum effect of the explosive, and therefore of the decoy.

BRIEF DESCRIPTION OF THE DRAWINGS

The invention will be explained in more detail with reference to one exemplary embodiment in the drawing, in which.

DETAILED DESCRIPTION OF THE INVENTION

Figure 1:
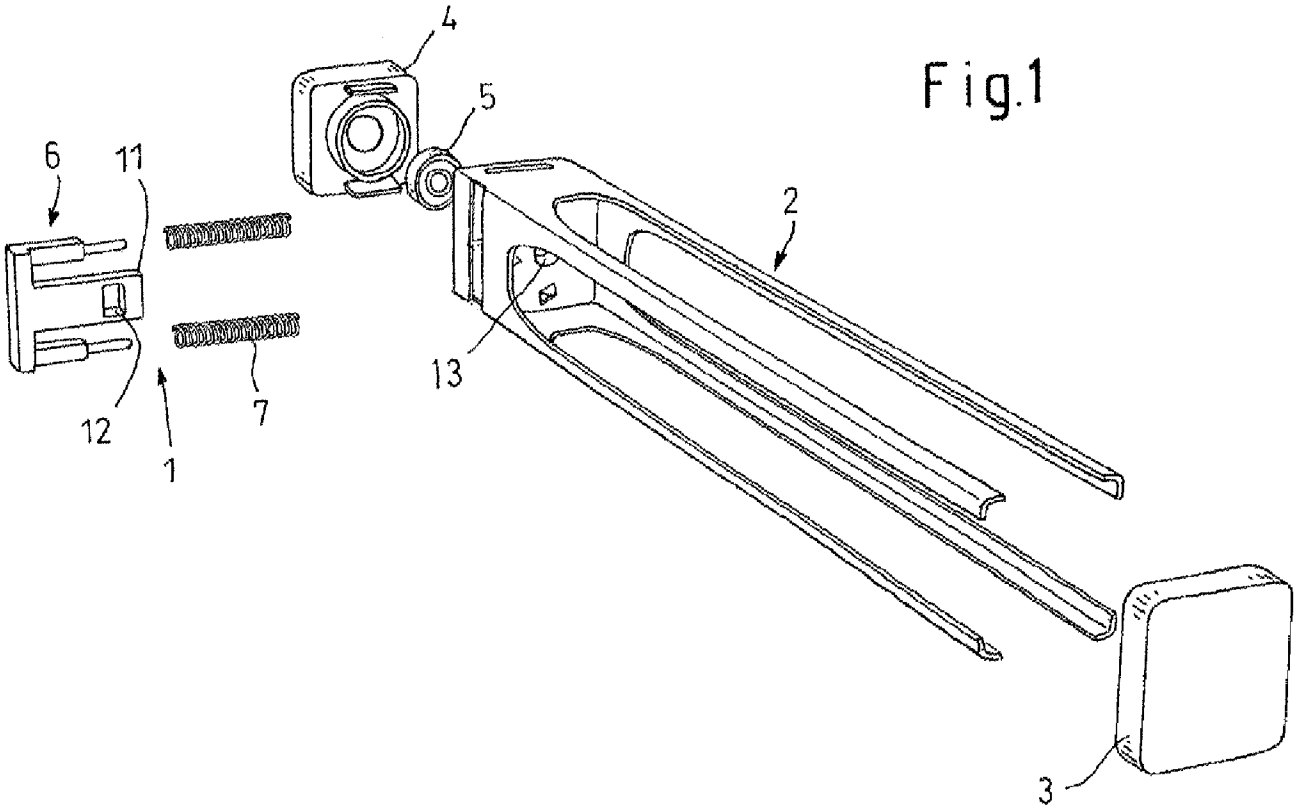
FIG. 1 shows a safety device with an explosive container, in the form of a view from the ejection side.
Figure 2:
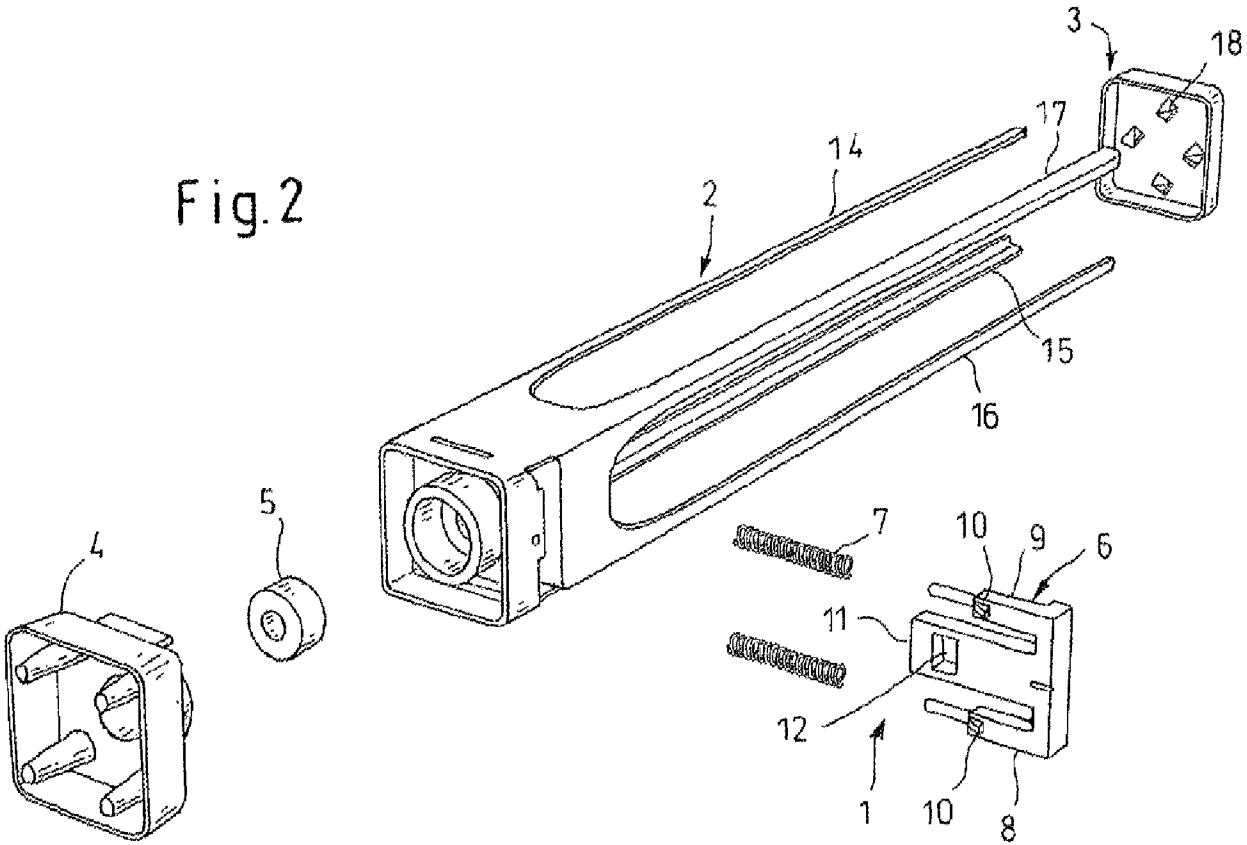
FIG. 2 shows the safety device shown in FIG. 1, in a view from the firing side.
Figure 6:
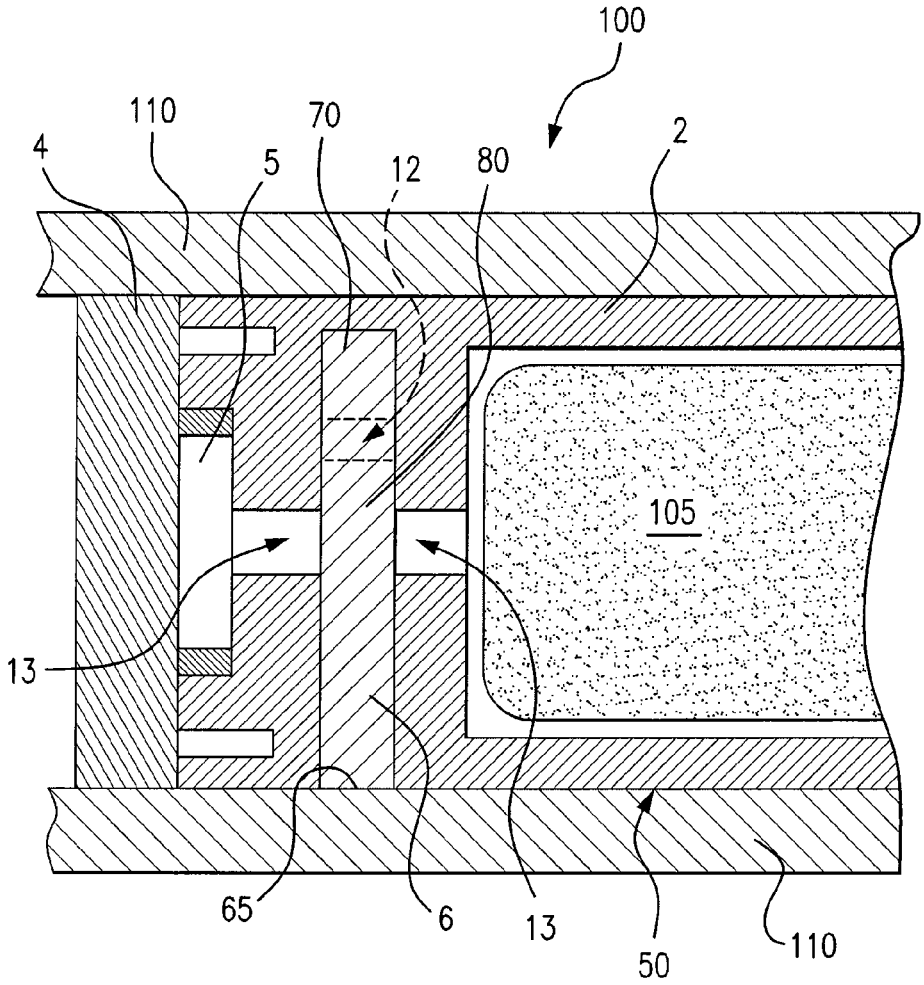
FIG. 6 is a schematic cross-sectional diagram of a decoy provided with a simple safety device in accordance with the present invention.

FIGS. 1 and 2 show those parts of a safety device 1 that are essential for explanation, for a block of explosive (which is not illustrated in any more detail than by character reference 105 in FIG. 6), which forms a decoy 100 and is incorporated in an explosive container 2, in this case with incident-flow protection 3. Character reference 4 denotes a discarding sabot in the figures, and character reference 5 denotes a firing stemming charge. The safety device 1 is formed by a special tube sensor/slide 6 and is prestressed in function, for example, loaded by a spring 7.

The tube sensor 6 is U-shaped in order to hold the two springs 7. Tabs 10 are fitted to the webs 8, 9 of the tube sensor 6 in order to ensure the final position of the tube sensor 6 in the safety device 1. A structure 11, in the form of a polygonal column provided with an opening 12 formed therein, is incorporated between the two webs 8, 9 of the tube sensor 6.

Thus, when safety device 1 is assembled with the explosive container 2 that contains a block of explosives, and with the discarding sabot 4 and the firing stemming charge 5, the assembly forms the decoy 100 provided with a simple safety device, in accordance with the present invention. As shown schematically in FIG. 6, when the decoy 100 is placed in the launch tube 110 of a launcher, the safety device 1 is in the first position and operates to block a firing channel between the firing stemming charge 5 and the explosive 105. When the decoy 100 leaves the launch tube 110 of the launcher, the safety device 1 operates to move the tube sensor 6 to the second position in order to open the firing channel 13 prior to firing the explosive 105 so that the firing stemming charge 5 may operate to fire the explosive 105. Thus, when the safety device 1 is in the first position, it operates to close the firing channel 13 prior to firing of the explosive 105 so that the stemming charge 5 cannot fire the explosive, which makes the explosive safer to handle. Once the tube sensor 6 of the safety device 1 has moved to the second position, then the firing channel 13 is open and the firing stemming charge 5 is ready to fire the explosive 105 through the firing channel 13.

When the safety device 1 moves to the third position, it operates to close the firing channel 13 after the stemming charge 5 fires the explosive 105 so that the safety device 1 contributes to an optimum effect of the explosive being realized by preventing "blowing out" energy loss through the firing channel 13. These various features of the present invention are described in more detail below.

Figure 3:
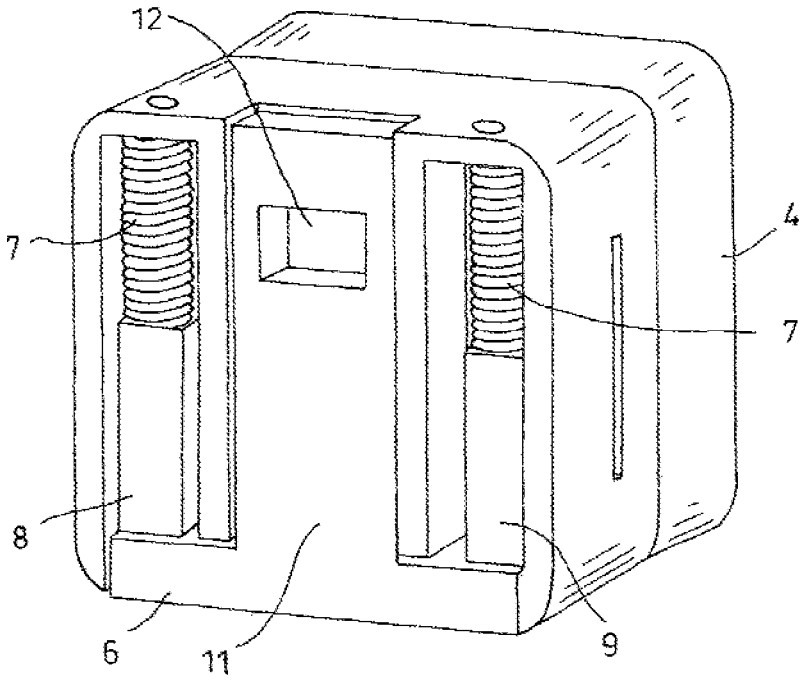
FIG. 3 shows an illustration of the safety device—firing channel blocked (first position)

FIG. 3 shows the safety device 1 in the assembly with the discarding sabot 4 and the firing stemming charge 5. The tube sensor/slide 6 is disposed to ensure that the firing chain to the explosive 105 is interrupted during the casing passage (within the submunition, prior to when the explosive container 2 is ejected—not illustrated in any more detail) of a first unit comprising the safety device/explosive container. In other words, the first unit comprises the safety device 1 and the explosive container 2. When the first unit is placed in the casing of the decoy 100, and the decoy 100 is placed in the launch tube 110 of a launcher, the tube sensor 6 is placed in a first position as shown in FIG. 3. The firing channel 13 is blocked in FIG. 3 due to the first position of the tube sensor 6 so that the firing stemming charge 5 cannot fire the explosive contained within the decoy. In the first position, a second portion 80 of the polygonal column structure 11 of the tube sensor 6 is aligned to block the firing channel 13, and a base portion 65 of the sensor 6 is aligned with the external surface 50 of the casing of the explosive container 2 (See, e.g., shown flush in FIG. 6). Although not shown in more detail than in FIG. 6, the launch tube 110 of a launcher, in which the decoy 100 is placed, maintains the tube sensor 6 in the first position while the first unit is contained in the launch tube 110.

Figure 4:
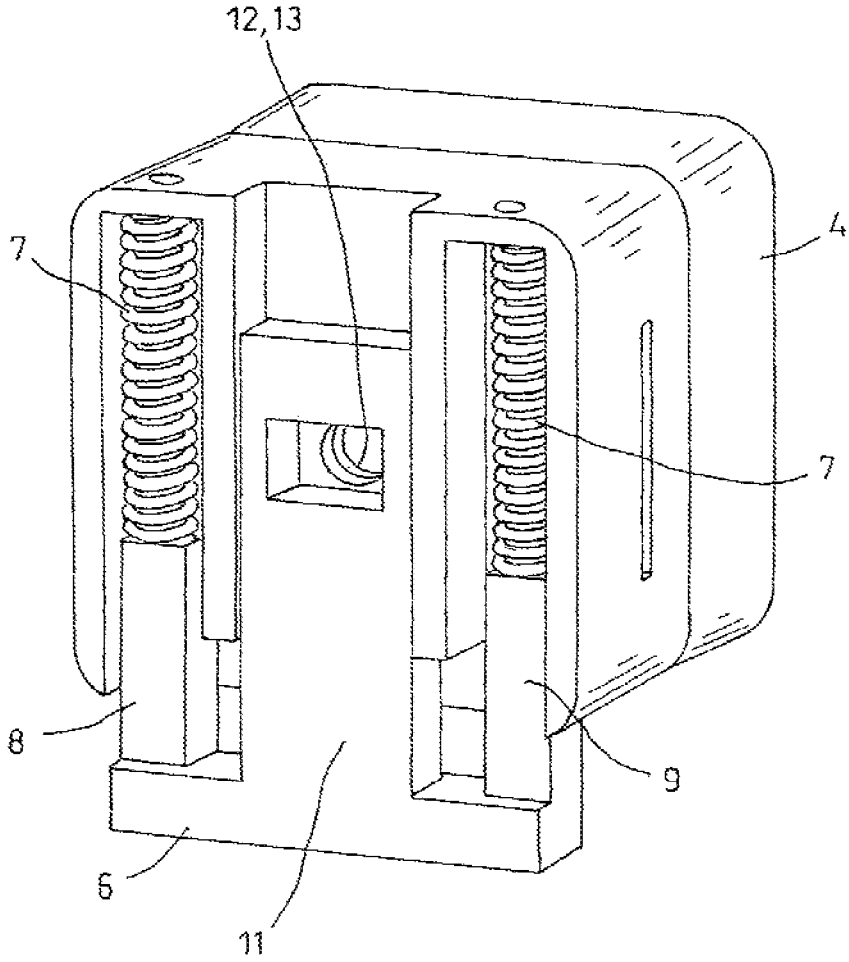
FIG. 4 shows an illustration of the safety device—firing channel open (second position)

As evident from FIGS. 3 and 4, spring prestressing of the tube sensor 6 ensures that, when the tube sensor 6 emerges from the casing of the decoy 100 (as happens when the decoy 100 leaves the launch tube 110), the initial interruption in the firing chain to the explosive is removed and the firing channel 13 is released and opened because the tube sensor 6 moves from the first position to a second position. In the second position, the opening 12 formed in the polygonal column structure 11 of the tube sensor 6 is aligned with the firing channel 13. FIG. 4 shows the tube sensor 6 positioned in the second position to open the firing channel 13. Thus, when the tube sensor 6 is in the second position as shown in FIG. 4, the firing channel 13 is open and the firing stemming charge 5 may fire the explosive 105. Although not explicitly shown in the drawings, the tube sensor 6 moves to the second position when the first unit emerges from the launch tube 110 because the wall of the launch tube 110 is no longer in position to maintain the tube sensor 6 in the first position.

Figure 5:
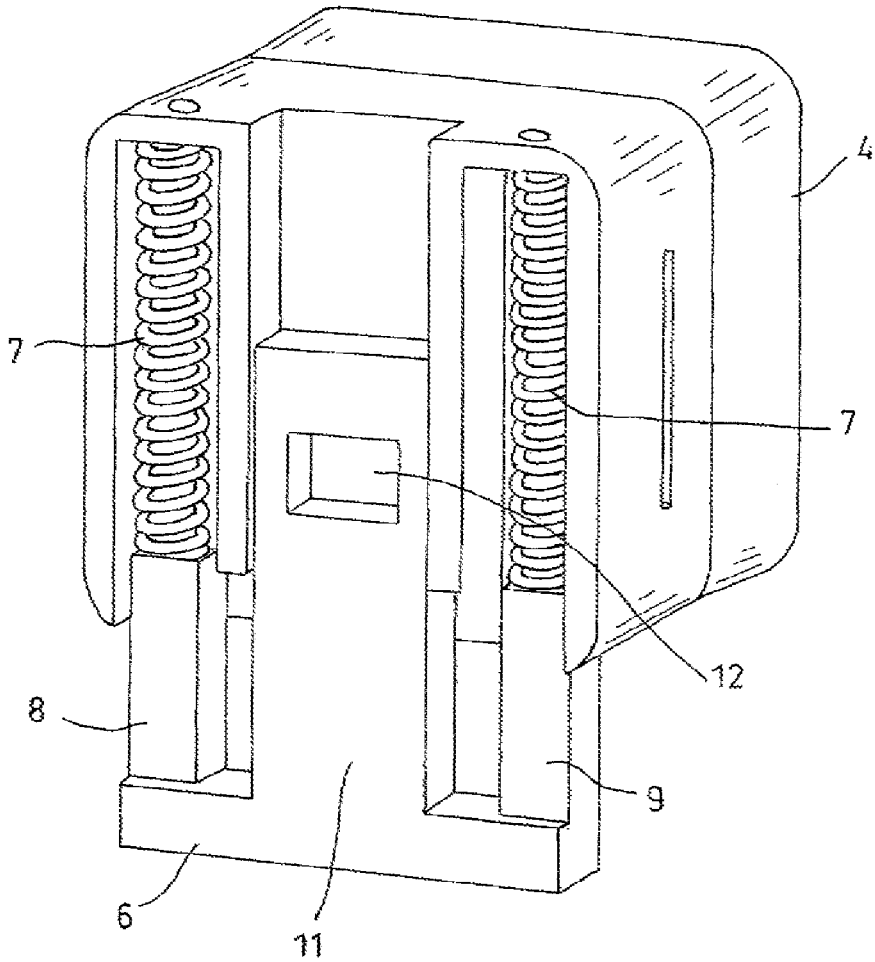
FIG. 5 shows an illustration of the safety device—firing channel blocked again (third position)

The shape of the tube sensor 6 and its spring prestressing allow the firing tube to be interrupted again, and the firing channel 13 is to be finally closed, when the tube sensor 6 moves on to a third position (See FIG. 5, also referred to as the "final position"). When the tube sensor 6 is in the third position, as shown in FIG. 5, the firing channel 13 is blocked by a first portion 70 of the polygonal column structure 11 located at a tip of the polygonal column structure. The tube sensor 6 moves into the third position due to the force of the springs 7, and after the first unit has emerged from the launch tube 110 of the launcher, and after the tube sensor 6 has moved through the second position.

In sum, when the first unit is contained in the launch tube 110 of a launcher, as shown in FIGS. 3 and 6, the sensor tube 6 is maintained in the first position by the walls of the launch tube 110, and the firing channel 13 is blocked by a second portion 80 of the tube sensor 6 so that the firing stemming charge 5 cannot fire the explosive 105. Then, when the first unit emerges from the launch tube of the launcher, the springs 7 force the tube sensor 6 to move to the second position in which the opening 12 of the sensor 6 is aligned with the firing channel 13 (see FIG. 4) so that the firing stemming charge 5 may fire the explosive contained in the explosive container 2 of the first unit. After the firing stemming charge 5 has fired the explosive 105 in the explosive container 2, the springs 7 continue to move the tube sensor 6 into the third position (see FIG. 5), in which a first portion 70 of the tube sensor 6 blocks the firing channel 13 in order to prevent "blowing out" energy loss through the firing channel 13. As evident from FIGS. 3, 4, 5 and 6, the opening 12 formed in the polygonal column structure 11 of the tube sensor 6 is disposed between the first portion 70 (i.e., tip portion) and the second portion 80 of the polygonal column structure 11.

In the event that the firing stemming charge 5 malfunctions, and/or in the event that the explosive 105 fails to detonate after the firing stemming charge 5 is fired, the fact that the tube sensor/slide 6 moves into the final or third position provides another safety advantage. By reclosing the firing channel 13, the tube sensor/slide 6 of the safety device 1 makes the undetonated explosive 105 safer to handle.

Thus, in accordance with the present invention, the safety device 1 initially blocks the firing channel 13 when the tube sensor 6 is in the first position. The tube sensor 6 is maintained in the first position by the walls of the launch tube 110, in which the decoy 100 has been placed. When the decoy 100 leaves the launch tube 110, the tube sensor 6 "senses" that the constraining force of the wall 110 is no longer present, and the springs 7 move the tube sensor 6 to the second position, and then on to the third position. By adjusting the spring force (or spring path), the time it takes for the tube sensor 6 to reach the second position, and then the third position, after the decoy 100 has left the launch tube 110 can be adjusted. In this way, the time it takes for the firing channel 13 to open and then reclose again can be determined. This construction leads to the result that the explosive container 2 is only an illuminated target during a particular activation time or distance. Furthermore, this construction makes it possible to equalize tolerance deviations of the explosive substances.

The incident-flow protection 3 in the form of an incident-flow protective cap additionally provides a protective, supporting, guidance and positioning function for the block of explosive 105, which is packed in protective film (not illustrated in any more detail, because this is known). The cap 3, which is preferably provided with a sealing and/or an adhesive compound, is plugged on the ejection side onto two or more edge profiles 14, 15, 16, 17 of the explosive container 2.

The cap 3, furthermore, preferably has positioning spikes 18. These ensure that the block of explosive 105 is centered in the cap 3 and is held in its optimum position for operation.

While the present invention has been described with respect to an embodiment wherein the block 105 of explosives is incorporated in an explosive container 2 that is launched from a launch tube 110 so that the tube sensor 6 is pushed towards the outside due to the power of the springs 7, the invention is not limited to this embodiment. For example, in the case wherein multiple blocks 105 of explosive are enclosed in a sheath, from which the blocks 105 are expelled, the tube sensor 6 may be arranged so that it is pushed to the outside by the force of spring power. In this way, if several blocks 105 of explosive are spent via an ammunition, and then expelled, the tube sensor 6 still moves towards the outside to enable firing of the explosive blocks 105 through the firing channel 13.

In accordance with another embodiment of the invention, the explosive block 105 is directly integrated into the magazine of a weapon so that the magazine functions as the launch tube. In this case, the explosive container 2 is disposed in a casing, which acts to constrain the tube sensor 6 in the first position until the explosive container 2 emerges from the casing thus permitting the tube sensor 6 to move to the second position and then to the third position. In this alternate embodiment of the invention, the walls 110 shown in FIG. 6 correspond to walls of the casing instead of to the walls of the launcher.

The invention claimed is:

1. A safety device associated with a block of explosives that forms a decoy, wherein the safety device is incorporated in an explosive container of the decoy, and the decoy further comprises a discarding sabot and a firing stemming charge attached to the discharging sabot, wherein the safety device comprises:

(a) a prestressed tube sensor/slide that is disposed between the discarding sabot and the firing stemming charge on one side and the block of explosives disposed in an explosive container on another side so that the prestressed tube sensor/slide is operable to open then reclose a firing channel disposed between the firing stemming charge and the block of explosives; and (b) one or more springs disposed to prestress the tube sensor/slide, wherein the tube sensor/slide is physically configured to have a U-shape provided by two webs, wherein a plurality of tabs are fitted to the two webs in order to ensure a final position of the tube sensor/slide in the safety device, and the tube sensor/slide includes a structure formed by a polygonal column provided with an opening formed therein, wherein the polygonal column is disposed between the two webs.

2. The safety device as claimed in claim 1, wherein the tube sensor/slide is moveable by the one or more springs from a first position to a second position and from the second position to a third position, wherein the third position is the final position.

3. The safety device as claimed in claim 2, wherein in the first position, the tube sensor/slide is disposed to block the firing channel disposed between the firing stemming charge and the block of explosives, and wherein in the second position, the tube sensor/slide is disposed to open the firing channel disposed between the firing stemming charge and the block of explosives, and wherein in the third position, the tube sensor/slide is disposed to reclose the firing channel disposed between the firing stemming charge and the block of explosives.

4. A decoy comprising:

(a) an explosive container that contains an explosive;

(b) a discharging sabot;

(c) a firing stemming charge attached to the discharging sabot, wherein the firing stemming charge is disposed to fire the explosive through a firing channel; and (d) a safety device incorporated in the explosive container and disposed to move from a first position to a second position and to a final position, wherein the safety device comprises i. a prestressed tube sensor/slide that is disposed between the discarding sabot and the firing stemming charge on one side and the explosive disposed in the explosive container on another side so that the prestressed tube sensor/slide is operable to open then reclose the firing channel disposed between the firing stemming charge and the explosive: and ii. one or more springs disposed to prestress the tube sensor/slide to move from the first position to the second position, and from the second position to the third position, wherein the tube sensor/slide is physically configured to have a U-shape provided by two webs, wherein a plurality of tabs are fitted to the two webs in order to ensure the final position of the tube sensor/slide in the safety device, and the tube sensor/slide includes a structure formed by a polygonal column provided with an opening formed therein, wherein the polygonal column is disposed between the two webs.

5. The decoy as claimed in claim 4, wherein the polygonal column of the tube sensor/slide includes a first portion and a second portion, wherein the opening formed in the polygonal column is disposed between the first portion and the second portion.

6. The decoy as claimed in claim 5, wherein in the first position, the tube sensor/slide is disposed to block the firing channel disposed between the firing stemming charge and the explosive, and wherein in the second position, the tube sensor/slide is disposed to open the firing channel disposed between the firing stemming charge and the explosive, and wherein in the third position, the tube sensor/slide is disposed to reclose the firing channel disposed between the firing stemming charge and the explosive.

7. The decoy as claimed in claim 4, wherein the decoy is a missile decoy.

8. The decoy as claimed in claim 4, wherein the discharging sabot and the firing stemming charge are connected in an interlocking manner to the explosive container via a click-fastening system.

9. The decoy as claimed in claim 8, further comprising:

(e) incident-flow protection comprising a cap disposed to provide protection, support, guidance and positioning functions for the explosive contained by the explosive container, wherein the explosive is packed in a protective film.

10. The decoy as claimed in claim 9, wherein the cap is provided with a compound that seals, or that is an adhesive, or that both seals and is an adhesive, so that the cap is plugged on an injection side onto two or more edge profiles of the explosive container.

11. The decoy as claimed in claim 10, wherein the cap includes positioning spikes that center the explosive in the cap and that hold the explosive in an optimum operating position.

12. The decoy as claimed in claim 9, wherein the cap includes positioning spikes that center the explosive in the cap and that hold the explosive in an optimum operating position.

* * * * *